US010272348B2

(12) United States Patent
Brant

(10) Patent No.: US 10,272,348 B2
(45) Date of Patent: Apr. 30, 2019

(54) PLUSH TOY KIT INCLUDING STORAGE COMPARTMENT FOR NOTECARDS ON SPECIAL OCCASIONS OR HOLIDAYS

(71) Applicant: Wendy Brant, Cumming, GA (US)

(72) Inventor: Wendy Brant, Cumming, GA (US)

(73) Assignee: Wendy Brant, Cumming, GA (US)

( * ) Notice: Subject to any disclaimer, the term of this patent is extended or adjusted under 35 U.S.C. 154(b) by 0 days.

(21) Appl. No.: 15/805,641

(22) Filed: Nov. 7, 2017

(65) Prior Publication Data

US 2018/0065053 A1 Mar. 8, 2018

Related U.S. Application Data

(62) Division of application No. 15/019,462, filed on Feb. 9, 2016, now abandoned.

(51) Int. Cl.
*A63H 3/00* (2006.01)
*A63H 3/02* (2006.01)

(52) U.S. Cl.
CPC ..... *A63H 3/005* (2013.01); *A63H 3/02* (2013.01)

(58) Field of Classification Search
CPC ..... A63H 3/003; A63H 3/005; A63H 3/02; A63H 33/00
USPC ..... 446/72, 75, 76, 369, 71, 73
See application file for complete search history.

(56) References Cited

U.S. PATENT DOCUMENTS 3,711,976 A * 1/1973 Allen ..... A47G 1/14 40/514
4,358,013 A * 11/1982 Shebley ..... A47G 33/00 206/232
4,577,753 A * 3/1986 Marhal ..... A63H 3/005 206/232
4,842,140 A * 6/1989 Mesnard ..... B65D 1/02 206/457
4,878,871 A * 11/1989 Noto ..... A63H 3/28 446/302
5,044,959 A * 9/1991 Shaver ..... A63F 9/0001 434/236

(Continued)

OTHER PUBLICATIONS

Arreguin, Maryn, "Let Your Light Shine Affirmation Note Card", https://www.behance.net/gallery/33930130/Let-Your-Light-Shine-Affirmation-Note-CardsPkg, May 11, 2016, 13 pgs.

(Continued)

*Primary Examiner* — Alexander R Niconovich
(74) *Attorney, Agent, or Firm* — Merchant & Gould, P.C.

(57) ABSTRACT

The present disclosure is generally directed to combining personalized thoughts and a gift into a single item. A method for using a kit is provided for creating and storing thoughts and memories on items in a container such as a plush toy. The kit includes media such as a plurality of paper sheets, notecards, and/or letters. During the special occasion or holiday, the paper sheets, the writing implement and the instructions are removed from the internal storage compartment of the container. Completed paper sheets are returned to the internal storage compartment for safekeeping. The completed paper sheets are retained inside the plush toy in a safe and organized manner but may then be subsequently removed from the internal storage compartment of the plush toy and read in order to reflect upon on the past special occasion, holiday or event.

17 Claims, 5 Drawing Sheets

(56) References Cited

U.S. PATENT DOCUMENTS 5,059,149 A * 10/1991 Stone ..... A63H 3/003 446/147
5,324,201 A * 6/1994 Friedel ..... G09B 19/00 434/236
6,301,812 B1 * 10/2001 Klunk ..... G09F 11/21 283/117
6,439,946 B1 * 8/2002 Schneider ..... A63H 3/005 446/268
6,447,363 B1 * 9/2002 Carraway ..... A47G 33/00 434/245
6,725,591 B2 * 4/2004 McLaughlin, Jr. ..... G09F 11/30 40/306
7,182,601 B2 * 2/2007 Donnan ..... A63H 3/005 434/236
7,308,741 B1 * 12/2007 Rydberg ..... A61G 17/08 27/1
7,461,421 B1 * 12/2008 Faircloth ..... A47G 9/1045 5/630
8,152,587 B1 * 4/2012 Brown ..... A63H 3/02 206/216
8,628,332 B2 * 1/2014 Billings ..... G09B 19/00 434/236
8,636,518 B2 * 1/2014 Wetherbee ..... G09B 19/00 434/236
9,072,979 B2 * 7/2015 Hengel ..... A63H 3/02
9,224,310 B2 * 12/2015 Wetherbee ..... G09B 1/02
9,925,470 B1 * 3/2018 Palacio ..... A63H 3/005
10,092,123 B2 * 10/2018 Drew ..... A47G 33/00
2002/0168919 A1 * 11/2002 Perkins ..... A63H 3/005 446/369
2006/0089076 A1 * 4/2006 Jacobson ..... A63H 3/005 446/71
2017/0246546 A1 * 8/2017 Brown, Sr. ..... A63H 3/005

OTHER PUBLICATIONS

Pillow Pets , https://en.wikipedia.org/wiki/Pillow-Pets, May 11, 2016, 5 pgs.

* cited by examiner

PLUSH TOY KIT INCLUDING STORAGE COMPARTMENT FOR NOTECARDS ON SPECIAL OCCASIONS OR HOLIDAYS

CROSS-REFERENCE TO RELATED APPLICATIONS

The present application is a division of and claims priority to U.S. patent application Ser. No. 15/019,462, filed Feb. 9, 2016, now abandoned, entitled PLUSH TOY KIT INCLUDING STORAGE COMPARTMENT FOR NOTECARDS ON SPECIAL OCCASIONS OR HOLIDAYS, the disclosure of which is hereby incorporated by reference in its entirety.

TECHNICAL FIELD

The field of the embodiments presented herein is directed toward a container such as a pillow or plush toy including an internal storage compartment for housing special occasion or holiday items as well as tools and materials for creating and personalizing the special occasion or holiday items before placing them inside the storage compartment for safekeeping.

BACKGROUND

It is commonplace to give or send notecards, letters, and handwritten notes to loved ones on special occasions or on holidays. Gifts are also given, but the personal thoughts written on the notecards and letters are often of more value to the recipient than the gift itself. However, the notecards and letters are often lost, misplaced or stored away in places that become difficult to access. Sometimes they are just forgotten.

It is with respect to these and other considerations that the disclosure herein is presented.

SUMMARY

It should be appreciated that this Summary is provided to introduce a selection of concepts in a simplified form that are further described below in the Detailed Description. This Summary is not intended to be used to limit the scope of the claimed subject matter.

In one embodiment disclosed herein, a kit is provided. The kit includes a container having at least one storage compartment, a writing implement, a plurality of paper sheets, and instructions with information on how the paper sheets are to be used including examples of indicia which may be included on one or more of the paper sheets. One or more users such as friends or family members utilize the writing implement to provide indicia on one or more of the plurality of paper sheets. The storage compartment of the container then receives and retains the paper sheets having indicia thereon. The container may be visually displayed with the paper sheets that have indicia thereon retained within the storage compartment. The storage compartment may be opened later such as on an anniversary of the special occasion or the holiday to retrieve and reflect upon the paper sheets that have indicia thereon.

In another embodiment disclosed herein, a container assembly is provided. The container assembly includes a container having at least one storage compartment, a writing implement, a plurality of paper sheets configured to be folded wherein one or more paper sheets are sized to be received and retained within the storage compartment when folded, and instructions with information on how the plurality of paper sheets are to be used including examples of indicia which may be included on one or more of the plurality of paper sheets. The storage compartment of the container initially retains the plurality of paper sheets, the writing implement and the instructions. The paper sheets, the writing implement and the instructions are removable from the storage compartment of the container. One or more of the paper sheets when folded and include indicia created with the writing implement are returned to the storage compartment of the container after having been removed.

In another embodiment disclosed herein, a method for retaining and organizing thoughts expressed in the form of indicia provided from loved ones or holidays or special occasions is provided. The method includes receiving via a first user a container having a storage compartment, providing to a plurality of other users a plurality of paper sheets, a writing implement and instructions comprising information on how the plurality of sheets are to be used including examples of indicia which may be included on one or more of the plurality of paper sheets; providing, via one or more of the plurality of other users utilizing the writing implement, indicia on one or more of the paper sheets; configuring one or more paper sheets having indicia thereon to be received and retained within the storage compartment of the container; and visually displaying the container with the one or more paper sheets having indicia thereon retained within the storage compartment of the container.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The embodiments presented herein will become more fully understood from the detailed description and the accompanying drawings, wherein.

DETAILED DESCRIPTION

Figure 1A:
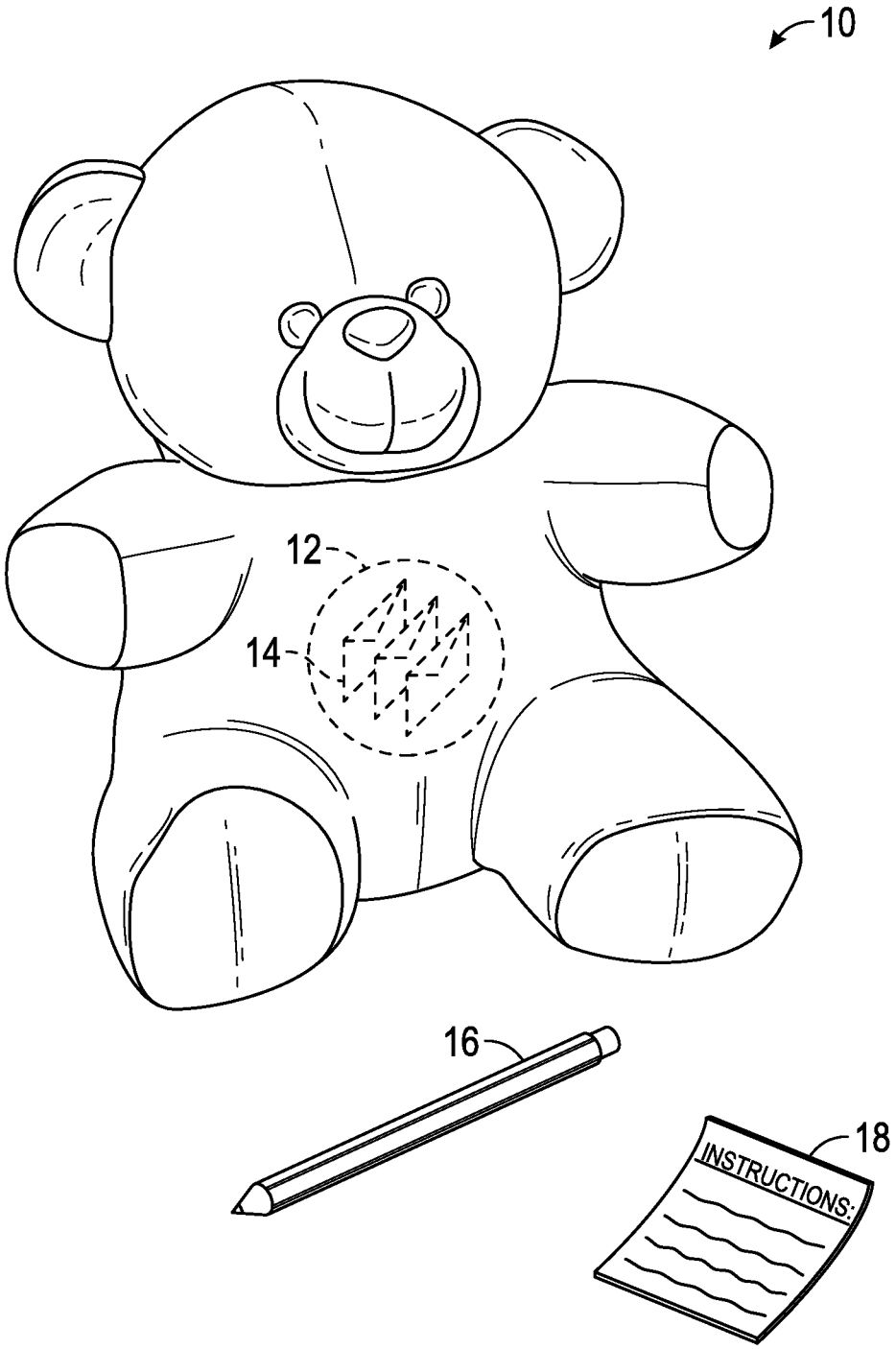
FIG. 1A illustrates one embodiment of a plush toy with an internal storage compartment shown in phantom for receiving and retaining notecards, letters, handwritten notes and other items according to at least one embodiment disclosed herein.

The following detailed description is directed to a kit, container assembly and method for retaining and organizing thoughts expressed in the form of indicia provided from loved ones or holidays or special occasions. The present inventions are susceptible of embodiment in many different forms. There is no intent to limit the principles of the present inventions to the particular disclosed embodiments. In the following detailed description, references are made to the accompanying drawings that form a part hereof and in which are shown by way of illustration specific embodiments or examples. Referring to the drawings, in which like numerals represent like elements throughout the several figures, aspects of the present disclosure will be presented.

In one or more embodiments the present invention is a kit or container assembly of components or parts used and arranged to enable reflection upon a past special occasion or holiday. For example, the kit or container may be provided as a gift for a birthday, anniversary, or for an expecting mother. Thoughts, well wishes or words of encouragement can be conveyed to someone on the special day or holiday which are then archived in a storage compartment of a container such as a pillow or plush toy. Preferably, the container is flexible, but the storage compartment is rigidly defined and configured so that any contents are not damaged while the container is being handled, displayed or stored. The pillow or plush toy may be in the form of a teddy bear or some other animal or shape. Also, the container may be themed as a result of its configuration, color, decorations and/or writing included on its exterior.

Figure 1B:
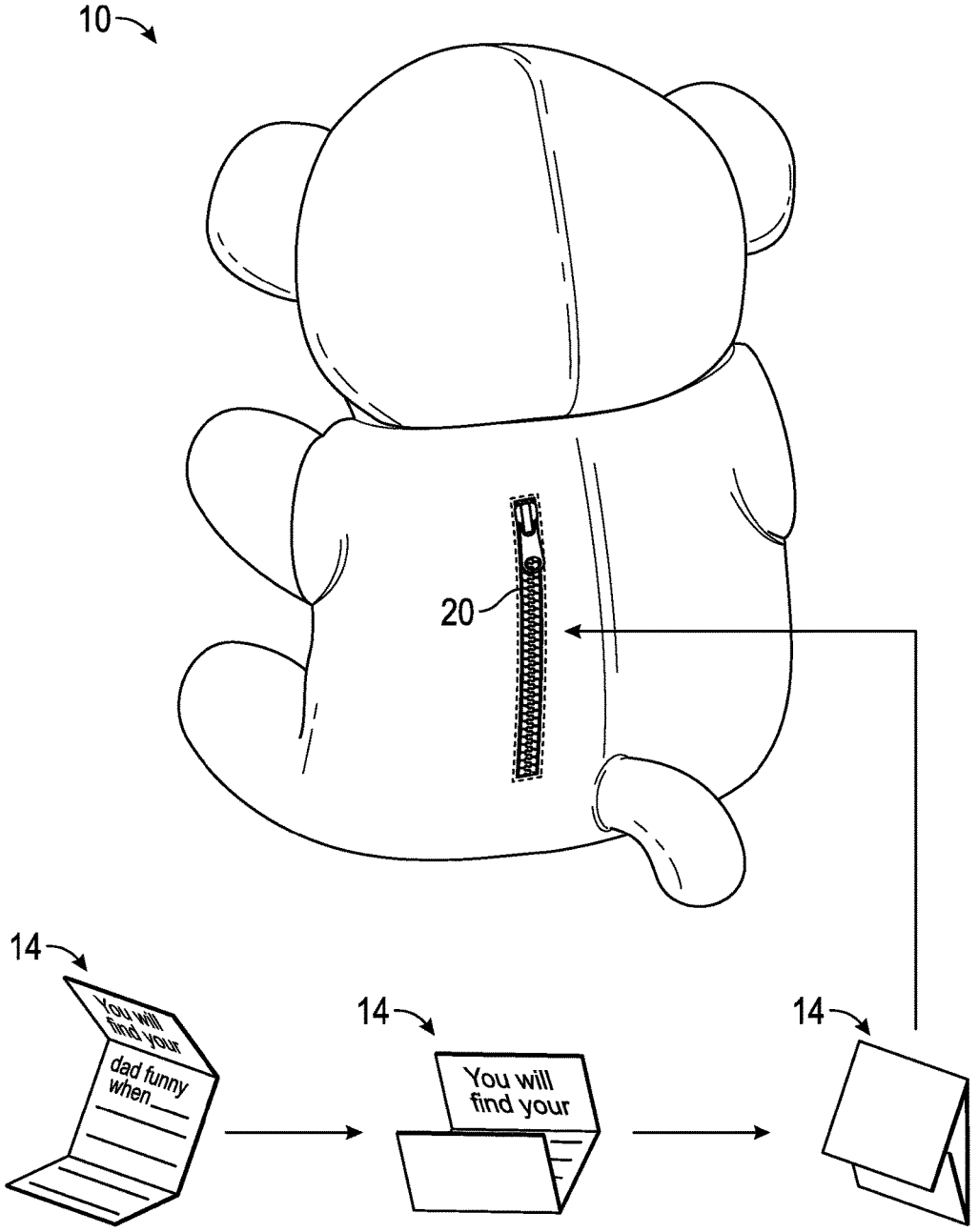
FIG. 1B illustrates a back view of the plush toy of FIG. 1A wherein a personalized note is folded and placed though an opening in the back to be received and retained within the storage compartment of the plush toy according to at least one embodiment disclosed herein.

FIGS. 1A and 1B illustrate one embodiment of a plush toy in the form of a teddy bear 10. The teddy bear 10 includes an internal storage compartment 12 for receiving and retaining media. For example, a plurality of paper sheets such as notecards 14 may be received and retained within the storage compartment 12. Alternatively, the media may take other forms suitable for receiving and recording indicia from a writing implement such as a pen or pencil.

For example, someone can purchase the teddy bear 10 as part of a kit that includes the notecards 14, at least one writing implement 16, and instructions 18 which include information on how the notecards 14 are to be used. The instructions could include examples of indicia which guests may include on one or more of the notecards 14. Preferably, more than one writing implement is included so that multiple notecards 14 may be completed at the same time. The notecards 14, writing implement 16 and instructions 18 may be included in the storage compartment 12 when purchasing the teddy bear 10 as a gift. Alternatively, the notecards 14, writing implement 16 and instructions 18 may be included as part of the purchase but separate from the storage compartment 12 of the teddy bear 10.

All or a portion of the plurality of notecards 14 may be blank or a portion of the plurality of notecards 14 may include a partial sentence or phrase for prompting or suggesting how to write out thoughts or to personalize the notecards 14. During an event one or more of the notecards 14 are provided to other users such as friends and family members which are present for an event. As explained in the instructions 18, these users can then utilize the writing implement 16 to personalize the notecards 14 by providing indicia on the notecard 14 that corresponds with their personalized thoughts or well wishes for another person that will ultimately be receiving the teddy bear 10. Notecards 14 that already include some indicia prompt the user to complete the sentence or thought. The instructions 18 may include examples of how to complete the notecards 14.

Upon each user completing their notecard 14, the completed notecard 14 is placed within the storage compartment 12 of the teddy bear 10. For example, as shown in FIG. 1B, the notecard is folded and the zipper 20 is unzipped in order for the folded notecard 14 to be placed within the storage compartment 12. Preferably, the notecards 14 are initially larger than the opening to the storage compartment 12 and therefore may be pre-folded or scored so that all the notecards 14 when completed would be the same size when received and retained within the storage compartment 12. Other means for keeping the storage compartment 12 closed may also be used such as fasteners.

Also, the completed and folded notecards 14 may first be placed inside a bag and then the bag with the notecards 14 inside may be placed inside the storage compartment 12. Alternatively, completed and folded notecards 14 may be first placed in a box or some other secondary container which is then placed inside the storage compartment 12. For example, the folded notecards 14 may be collected in the bag or box and then at the end of the event or afterwards the bag or box may be placed inside the storage compartment 12. In other words, the bag or box may be nested inside the container 10. In another embodiment, the collected notecards 14 may be removed from the bag or box at the end of the event or afterwards and then placed inside the storage compartment 12.

In one or more embodiments, the storage compartment 12 may include an indicator such as an alarm, a displayed date or blinking light that indicates or reminds someone to open the storage compartment 12 in order to provide the opportunity to recall the event by reading the notecards 14 again. Also, in one or more embodiments, a window may be provided so that it is possible to see notecards 14 inside the storage compartment 12.

Thus, a collection of completed notecards 14, with indicia there on, are received and retained within the storage compartment 12 of the teddy bear 10. Upon the conclusion of the event, the teddy bear 10 may then be visually displayed in a prominent manner by the user for which the notecards 14 were intended. In one or more embodiments, the container such as the teddy bear 10 is provided with internal structural members so that the teddy bear 10 remains sitting upright even when having completed notecards 14 inside the storage compartment 12. Sometimes a plush toy with such an internal structure is referred to as having a skeleton or as "boned." The storage compartment 12 may then be opened on an anniversary of the special occasion, holiday or event to retrieve the notecards 14. Thus, the completed notecards 14 are retained inside the teddy bear 10 in a safe and organized manner but may then be subsequently removed from the storage compartment 12 and read in order to reflect upon the past special occasion, holiday or event.

Figure 2:
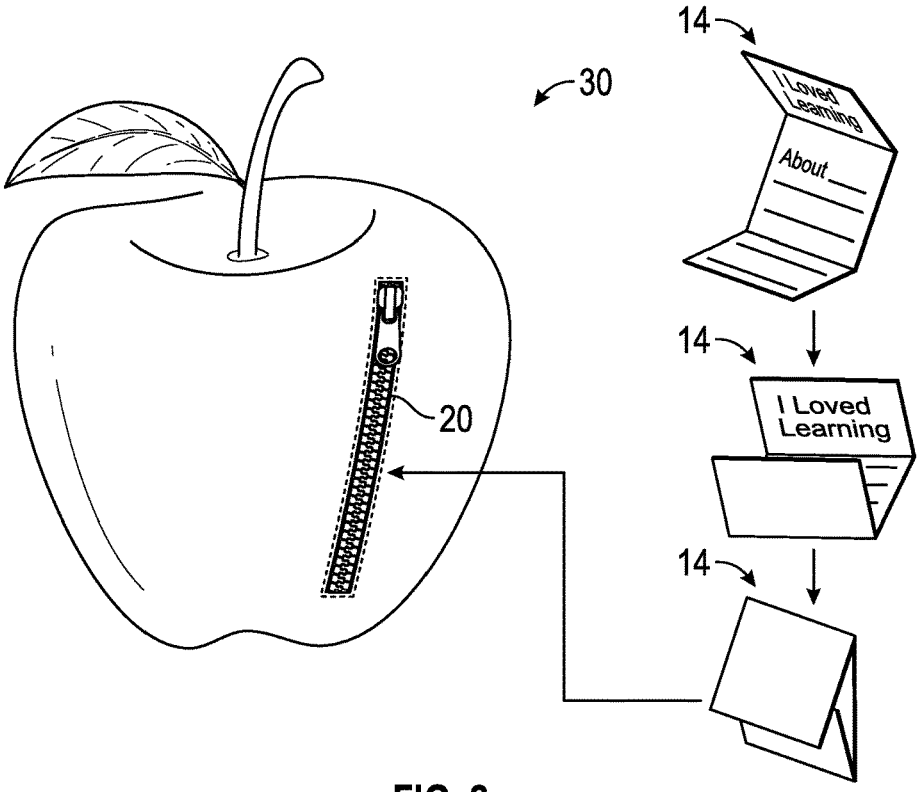
FIG. 2 illustrates a back view of a plush toy in the shape of an apple having an internal storage compartment for receiving and retaining notecards, letters, handwritten notes and other items according to at least one embodiment disclosed herein.
Figure 3:
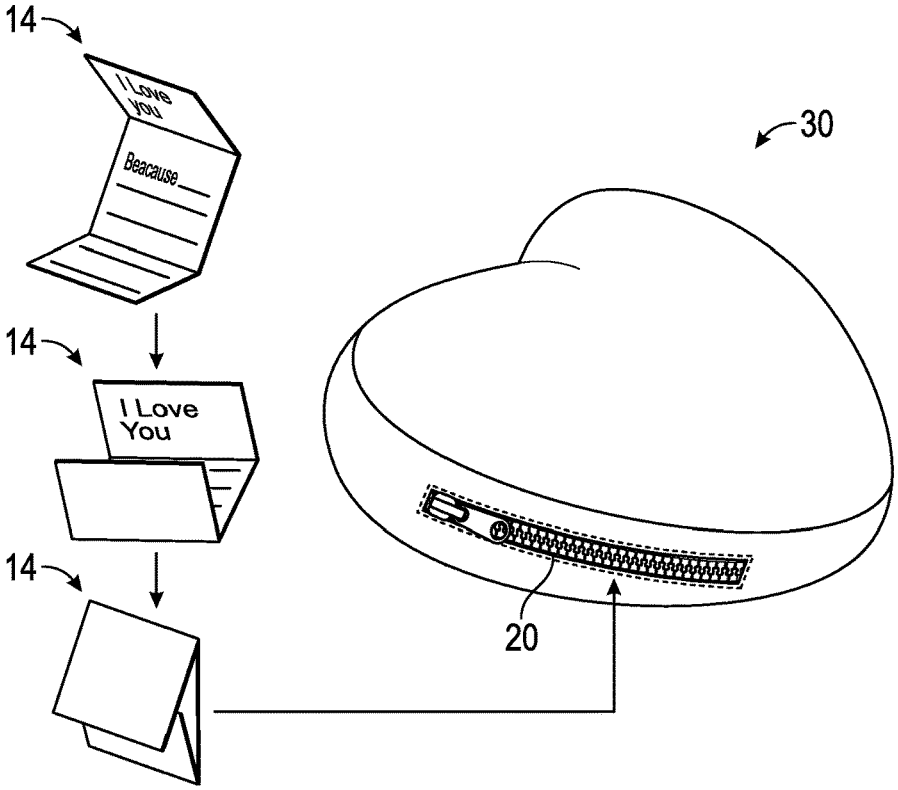
FIG. 3 illustrates a perspective view of a plush toy in the shape of a heart having an internal storage compartment for receiving and retaining notecards, letters, handwritten notes and other items according to at least one embodiment disclosed herein.
Figure 4A:
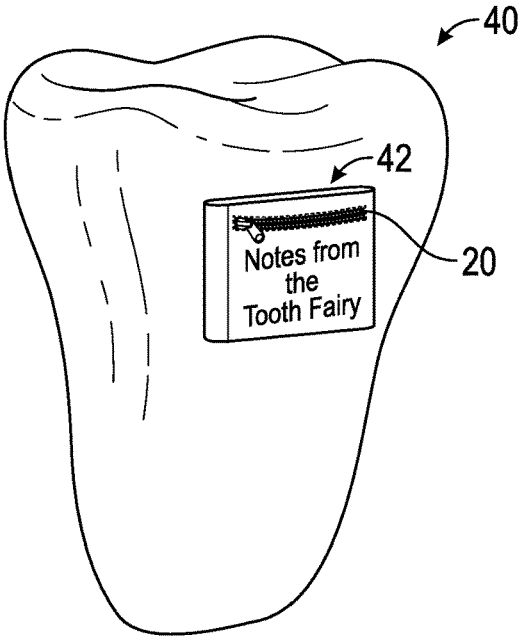
FIGS. 4A and 4B illustrate front and back views of a plush toy in the shape of a tooth having an internal storage compartment for receiving and retaining notecards, letters, handwritten notes and other items according to at least one embodiment disclosed herein.
Figure 4B:
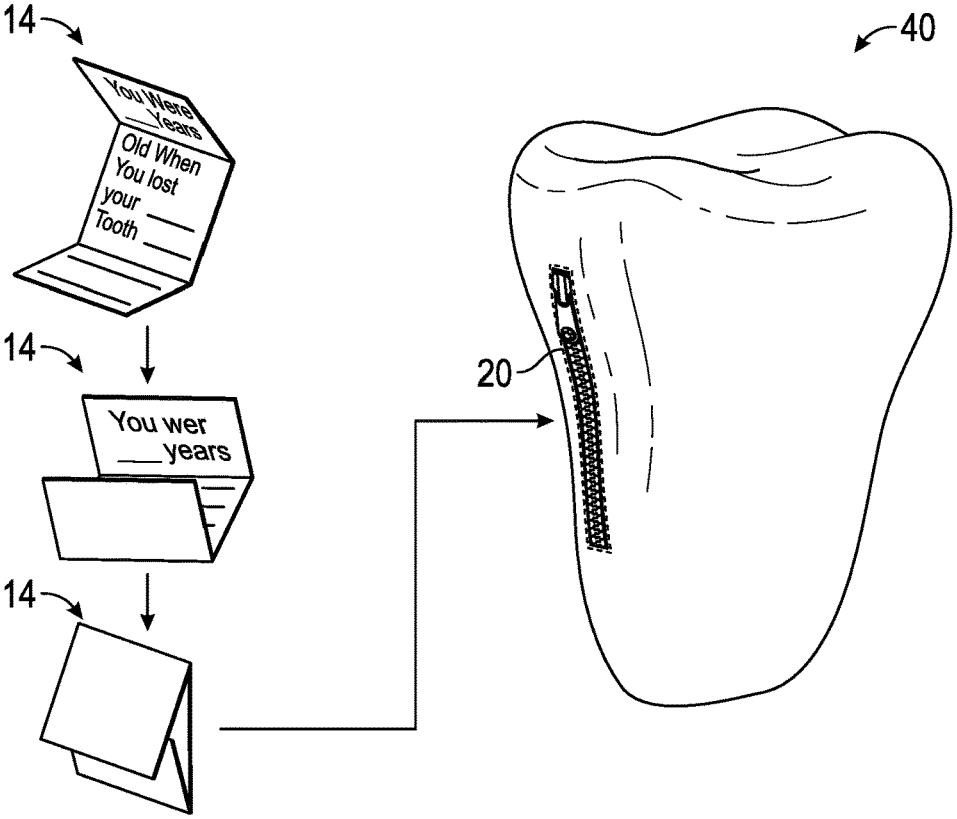
Figure 5A:
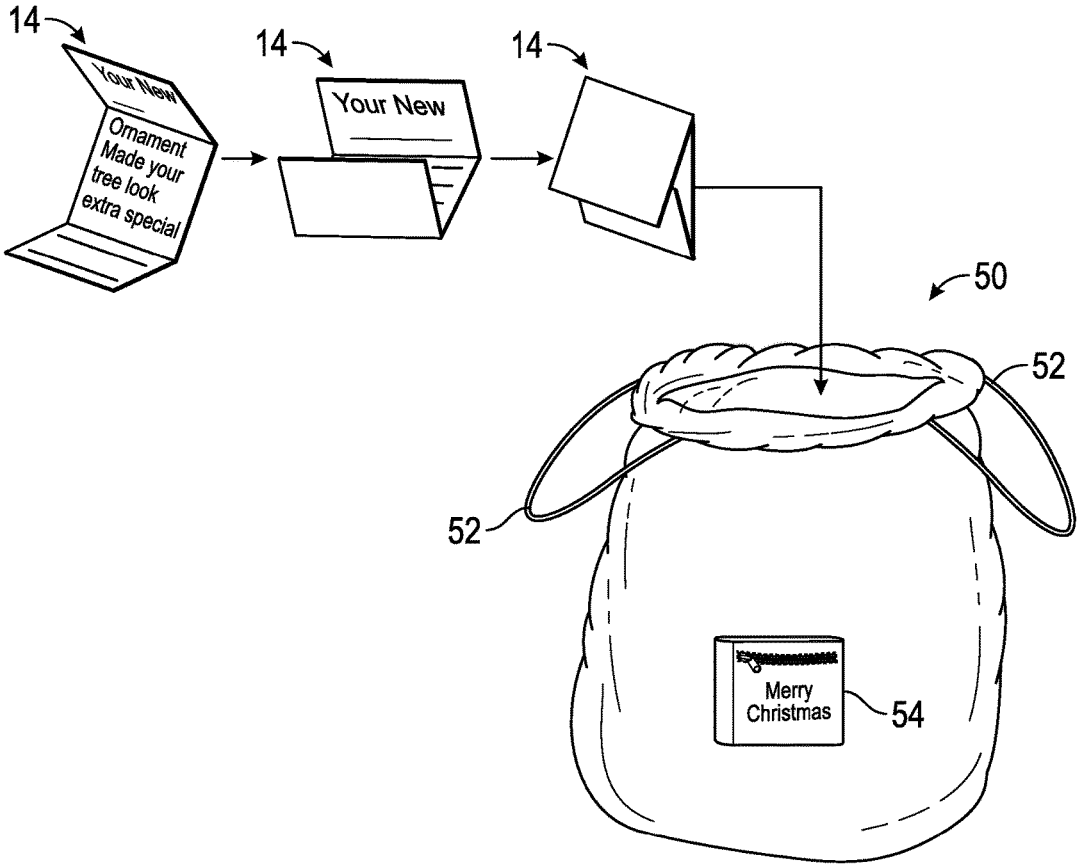
FIGS. 5A and 5B illustrate front and back views of a bag having an internal storage compartment for receiving and retaining notecards, letters, handwritten notes and other items according to at least one embodiment disclosed herein.
Figure 5B:
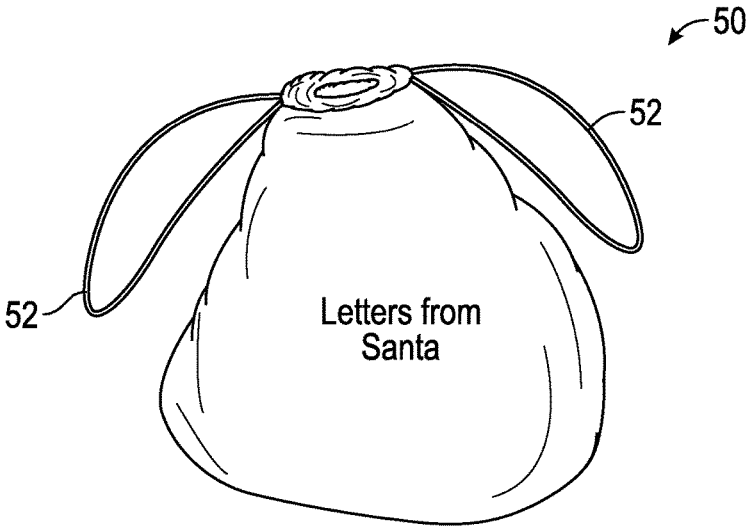

Instead of a teddy bear, the container with an internal storage compartment may take other shapes such as, but not limited to, an apple 26 for a teacher as illustrated in FIG. 2, a heart 30 with the zipper 20 on the side for valentine's day as illustrated in FIG. 3, a tooth 40 as illustrated in FIGS. 4A and 4B, or a bag 50 as illustrated in FIGS. 5A and 5B. The tooth 40 may also include a pocket 42 for holding a tooth that has fallen out which may be exchanged for money during the night. The bag 50 may have a Christmas theme and drawstrings 52 for closing the bag 50 as shown in FIG.

5B. The bag 50 may also include a pocket 54. Another example may be a ball configured for a particular sport.

In addition to the kit and container assembly, the present inventions also includes a method for retaining and organizing thoughts expressed in the form of indicia provided from loved ones on holidays or special occasions. The method includes the steps of receiving via a first user a container having a storage compartment; providing to a plurality of other users a plurality of paper sheets, a writing implement and instructions comprising information on how the plurality of sheets are to be used including examples of indicia which may be included on one or more of the plurality of paper sheets; providing, via one or more of the plurality of other users utilizing the writing implement, indicia on one or more of the plurality of paper sheets; configuring one or more of the plurality of paper sheets having indicia thereon to be received and retained within the storage compartment of the container; and visually displaying the container with the one or more of the plurality of paper sheets having indicia thereon retained within the storage compartment of the container.

The method may also include removing the one or more paper sheets having indicia. For example, the method may further include opening the storage compartment of the container on an anniversary of a special occasion, holiday or event to retrieve the one or more of the plurality of paper sheets having indicia thereon. The step of configuring one or more of the plurality of paper sheets having indicia thereon may include folding each of the one or more of the plurality of paper sheets having indicia thereon.

Unless otherwise indicated, more or fewer operations may be performed than shown in the figures and described herein. Additionally, unless otherwise indicated, these operations may also be performed in a different order than those described herein.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A method for organizing and retaining thoughts expressed in the form of indicia provided from loved ones, the method comprising:

providing via a first user a container having a storage compartment;

providing to a plurality of other users at a social gathering or for a special occasion a plurality of paper sheets, a writing implement and instructions comprising information on how the plurality of sheets are to be used;

providing, via the plurality of other users utilizing the writing implement, indicia on the plurality of paper sheets, wherein the indicia can be provided from multiple users of the plurality of other users at the same time;

configuring the plurality of paper sheets having indicia thereon so as to retain privacy of the information provided by the indicia on each sheet, wherein the configured sheets may be placed and retained within the storage compartment of the container;

placing in the storage compartment of the container the plurality of paper sheets having indicia thereon obtained from the plurality of other users; and providing the container with the configured sheets therein to a recipient different than the first user or the plurality of other users who is unable to read the indicia provided on the plurality of paper sheets until the sheets are removed from the storage compartment such that the recipient can privately view the indicia at a later time after the social gathering or for the special occasion.

2. The method of claim 1 wherein configuring the plurality of paper sheets having indicia thereon comprises folding each of the plurality of paper sheets having indicia thereon.

3. The method of claim 1 further comprising removing the paper sheets having indicia from the storage compartment after a period of time.

4. The method of claim 1 further comprising opening the storage compartment of the container and retrieving one or more of the plurality of paper sheets having indicia thereon.

5. The method of claim 1 further comprising opening the storage compartment of the container on an anniversary of the social gathering or the special occasion to retrieve one or more of the plurality of paper sheets having indicia thereon.

6. The method of claim 1 wherein the instructions provided to the plurality of other users comprise examples of indicia which may be included on one or more of the plurality of paper sheets.

7. The method of claim 1 further comprising presenting the container with the configured plurality of paper sheets retained within the storage compartment to the recipient as a gift.

8. The method of claim 1 wherein the container having the storage compartment is provided as part of a kit further comprising:

the writing implement;

the plurality of paper sheets; and the instructions.

9. The method of claim 1 wherein the container is a plush toy.

10. A method for organizing and retaining thoughts expressed in the form of indicia provided from loved ones, the method comprising:

providing via a first user a plush toy having an internal storage compartment;

providing to a plurality of other users at a social gathering or for a special occasion a plurality of paper sheets, a writing implement and instructions comprising information on how the plurality of sheets are to be used;

providing, via the plurality of other users utilizing the writing implement, indicia on the plurality of paper sheets, wherein the indicia can be provided from multiple users of the plurality of other users at the same time;

folding the plurality of paper sheets having indicia thereon so as to retain privacy of the information provided by the indicia on each sheet;

placing in the storage compartment of the plush toy the plurality of paper sheets having indicia thereon obtained from the plurality of other users; and providing the plush toy with the folded sheets therein to a recipient different than the first user or the plurality of other users who is unable to read the indicia provided on the plurality of paper sheets until the sheets are removed from the storage compartment such that the recipient can privately view the indicia at a later time after the social gathering or for the special occasion.

11. The method of claim 10 further comprising removing the paper sheets having indicia from the storage compartment after a period of time.

12. The method of claim 10 further comprising opening the storage compartment of the plush toy and retrieving one or more of the plurality of paper sheets having indicia thereon.

13. The method of claim 10 further comprising opening the storage compartment of the plush toy on an anniversary of the social gathering or the special occasion to retrieve one or more of the plurality of paper sheets having indicia thereon.

14. The method of claim 10 further comprising presenting the plush toy with the folded plurality of paper sheets retained within the storage compartment to the recipient as a gift.

15. The method of claim 10 wherein the plush toy is shaped to correspond with a holiday or themed to correspond with a special occasion.

16. A method for organizing and retaining thoughts expressed in the form of indicia provided from loved ones, the method comprising:

providing a plush toy having an internal storage compartment;

providing to a plurality of users at a social gathering or for a special occasion a plurality of paper sheets, a writing implement and instructions comprising information on how the plurality of sheets are to be used;

instructing each one of the plurality of users to write their thoughts in the form of indicia on one of the plurality of paper sheets and instructing to fold the plurality of paper sheets having indicia thereon so as to retain the privacy of the information provided by the indicia, wherein the provision of the plurality of paper sheets allows multiple users of the plurality of users to be able to express their thoughts in the form of indicia at the same time;

informing the plurality of users that the folded sheets will be placed in the internal storage compartment of the plush toy for later presenting to a recipient different than the plurality of users;

placing in the storage compartment of the plush toy the plurality of paper sheets having indicia thereon obtained from the plurality of other users; and providing the plush toy with the folded sheets therein to the recipient who is unable to read the indicia provided on the plurality of paper sheets until the sheets are removed from the internal storage compartment such that the recipient can privately view the indicia at a later time after the social gathering or for the special occasion.

17. The method of claim 16, wherein the plush toy having the internal storage compartment is provided as part of a kit further comprising:

the writing implement;

the plurality of paper sheets; and the instructions.

* * * * *